United States Patent [19]

Bradford

[11] 4,089,000

[45] May 9, 1978

[54] HIGH ALTITUDE PULSE DOPPLER FUZE

[75] Inventor: William C. Bradford, Hyattsville, Md.

[73] Assignee: The United States of America as represented by the Secretary of the Navy, Washington, D.C.

[21] Appl. No.: 97,465

[22] Filed: Nov. 20, 1970

[51] Int. Cl.[2] ..... F42C 13/04

[52] U.S. Cl. ..... 343/7 PF

[58] Field of Search ..... 343/7 PF; 102/70.2 P

[56] References Cited

U.S. PATENT DOCUMENTS

| | | | |
|---|---|---|---|
| 3,603,999 | 9/1971 | Palleiko | 343/7 PF X |
| 3,833,905 | 9/1974 | Apstein | 343/7 PF |
| 4,032,918 | 6/1977 | Masin | 343/7 PF |

*Primary Examiner*—T.H. Tubbesing

*Attorney, Agent, or Firm*—R. S. Sciascia; A. L. Branning

[57] ABSTRACT

A high altitude pulse doppler ordnance fuze which includes a plate pulsed oscillator having an integrated loop antenna. A modulator coupled to the plate pulses the oscillator to provide main and secondary pulses. The main pulse produced in the oscillator is radiated to a target and the echo therefrom interacts with the secondary pulse produced in the oscillator to provide grid current variation indicative of doppler signal. Gate circuitry, including a differentiating circuit, monostable multivibrators, and a reset network, is responsive to the modulator output to gate a detector to detect the grid current variation and, therefore, obtain doppler information upon interaction of the echo and secondary pulse signals.

4 Claims, 11 Drawing Figures

FIG. 2
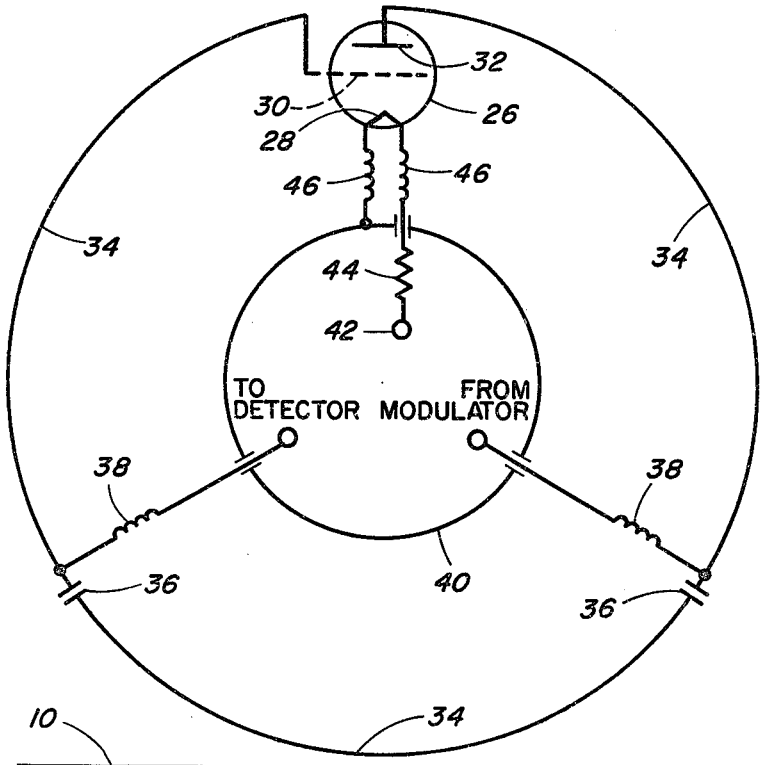
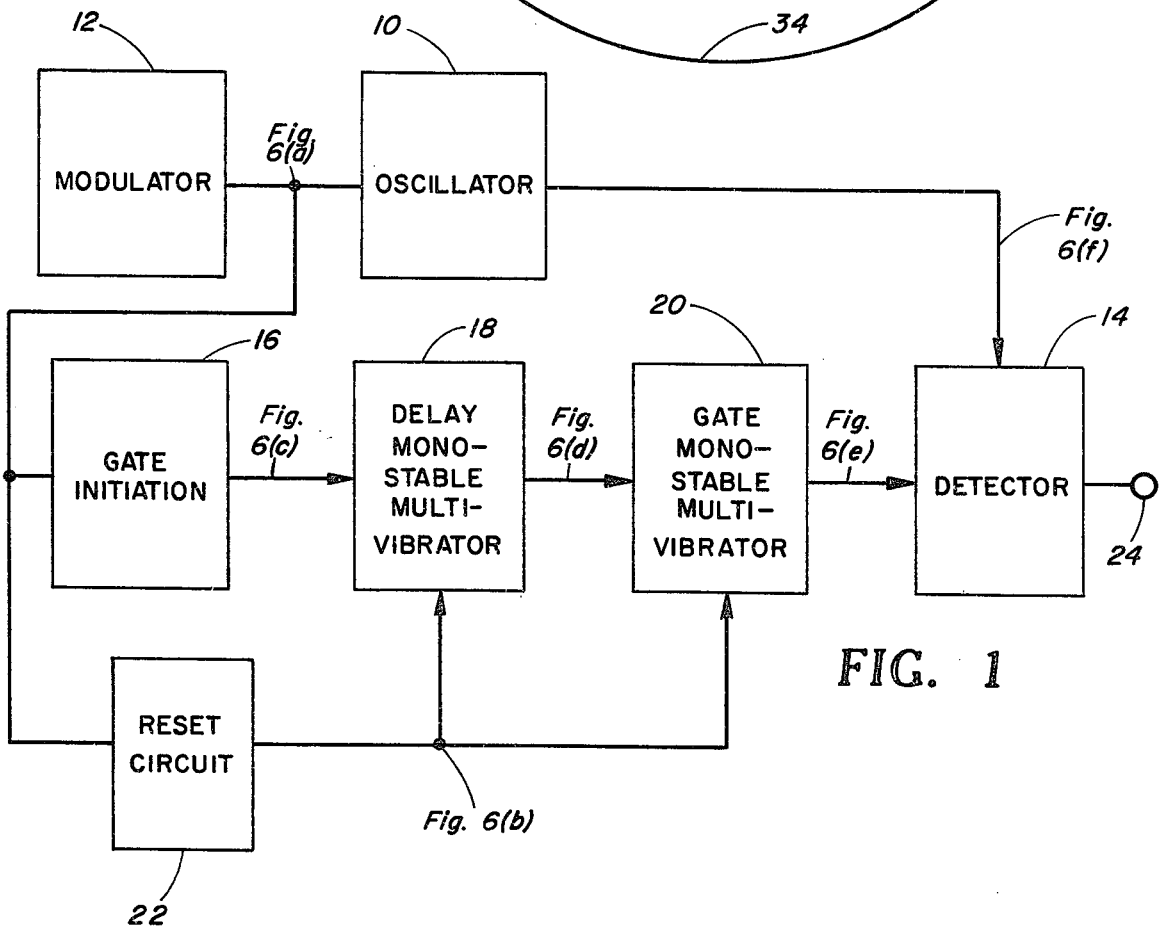
FIG. 1

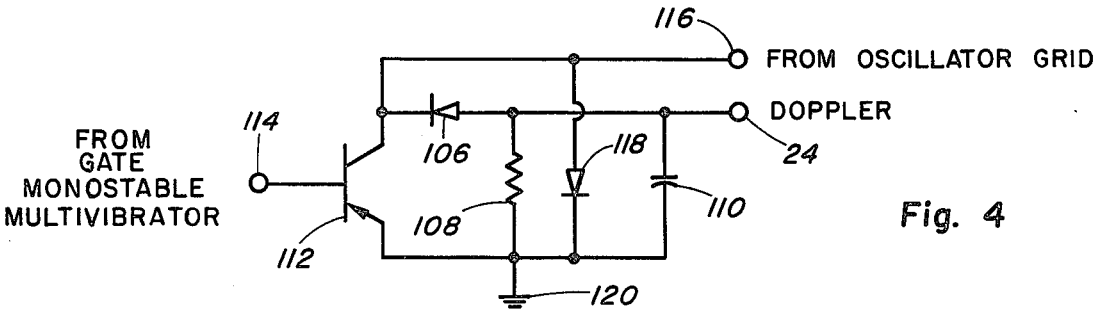
Fig. 4
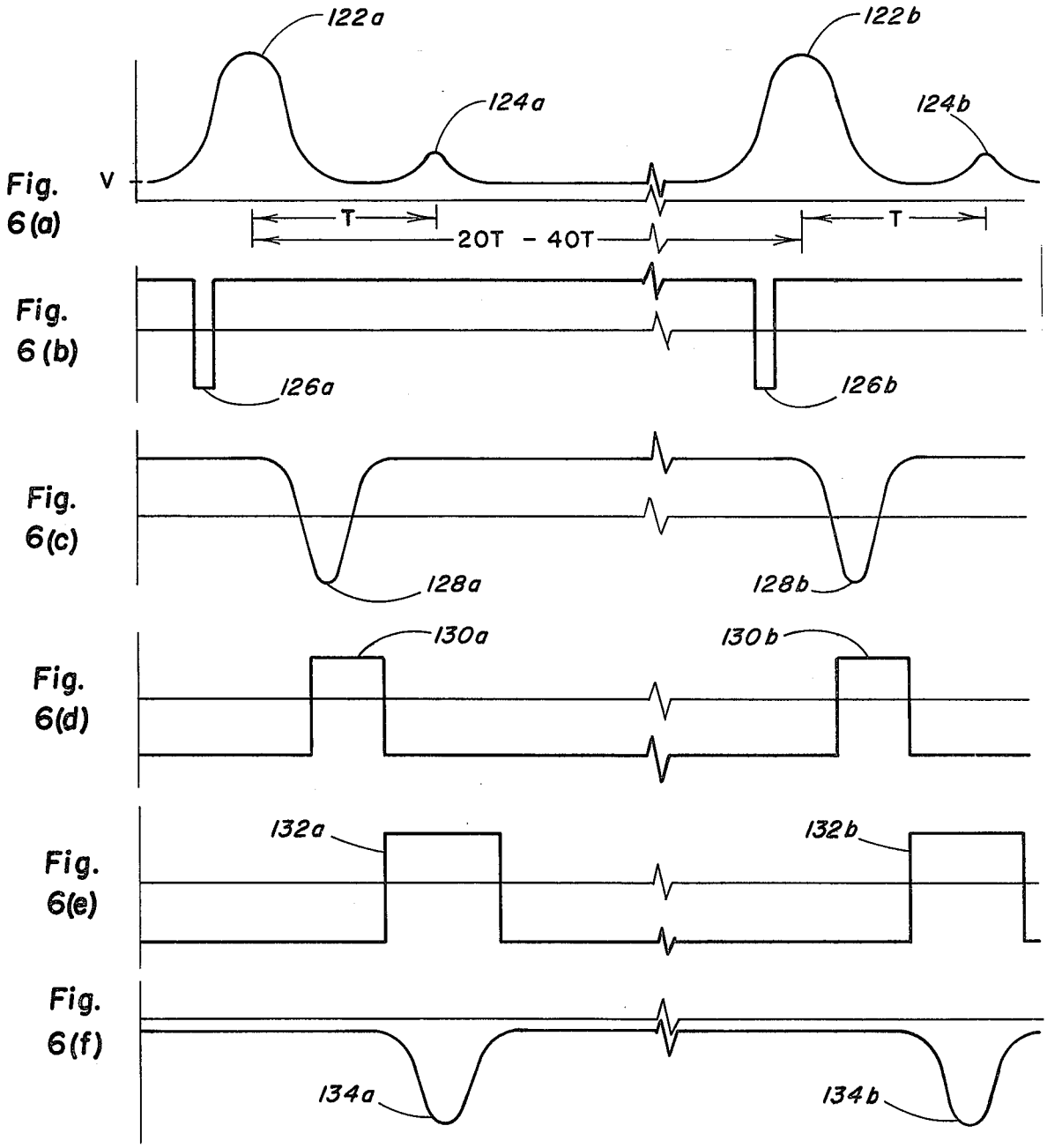

HIGH ALTITUDE PULSE DOPPLER FUZE

BACKGROUND OF THE INVENTION

This invention relates generally to ordnance proximity fuzes and, more particularly, to a high altitude doppler ordnance fuze.

Non-contacting ordnance fuzes utilizing the doppler effect, that is, the frequency shift due to the relative motion between the fuze and the desired target, are well known in the ordnance art. These ordnance fuzes transmit either a continuous signal or a pulse signal toward a target and, consequently, may be classified according to their mode of operation as continuous (CW) doppler or pulse doppler fuzes, respectively. If the CW doppler fuze is utilized in an aerial ordnance device, such as a bomb or the like, approaching a relatively stationary target, such as ground level, the doppler signature of the approaching target is a sinusoidal waveshape with a hyperbolic varying amplitude, that is, an amplitude having an instantaneous value inversely proportional to the height above ground level.

While CW doppler fuzes have operated satisfactorily at relatively low altitudes above ground, accurate functioning at higher altitudes above ground is exceedingly difficult because of the small incremental variation in the hyperbolic amplitude of the doppler signature at these higher altitudes.

Pulse doppler fuzes have provided operation at somewhat higher altitudes than CW doppler fuzes. Pulse doppler ordnance fuzes detect targets during the transmitted pulse only and, therefore, the hyperbolic doppler signature provided by CW fuzes is modified in that a doppler signal is detected only during interaction between the transmitted pulse and received echo pulse. The altitude at which interaction between the transmitted and received echo pulses first occurs is termed the range cutoff. As the pulse doppler fuze approaches a target, the doppler signature amplitude will suddenly increase from a zero value at altitudes above range cutoff to a non-zero value below range cutoff and then follow a hyperbolic pattern similar to that of CW doppler fuzes. This sudden change in doppler signature at range cutoff may be utilized advantageously to detonate the ordnance device at the range cutoff altitude which is somewhat higher than altitudes obtainable with CW doppler fuzes.

Generally, the designer of a pulse doppler ordnance fuze has little or no control over the range cutoff, which is a function of pulse width of the transmitted signal and is determined by other design requirements such as, for example, oscillator size, power requirements, etc. Thus, heretofore employed conventional pulse doppler fuzes are limited in operation to altitudes at or below range cutoff and, therefore, have been unable to provide high altitude operation. Furthermore, prior art pulse doppler fuzes are sensitive to countermeasure techniques, or the like, especially in the duration between pulses during which time oscillators utilized therein are in the regenerative region.

Application Ser. No. 14,833 filed by John J. Nastronero on Feb. 16, 1970, and of common assignee herewith, discloses a pulse doppler ordnance fuze which utilizes a radio frequency oscillator and modulator therefor which drives the oscillator from a CW mode to a pulse mode of operation thereby achieving improved countermeasure protection by not allowing the oscillator to enter the regenerative region between pulses.

However, the pulse doppler fuze disclosed therein is not operable at altitudes above range cutoff.

SUMMARY OF THE INVENTION

Accordingly, one object of the present invention is to provide an accurate ordnance proximity fuze.

Another object of the invention is to provide a pulse doppler ordnance fuze operable at altitudes above range cutoff.

A further object of the instant invention is to provide a non-contacting ordnance fuze which is resistant to jamming countermeasures or the like.

Briefly, these and other objects of the present invention are attained by providing a pulse doppler ordnance fuze having an oscillator which oscillates continuously and a modulator therefor which switches the oscillator from a low altitude CW mode of operation to a high altitude pulse mode of operation. A high altitude main pulse is transmitted to a target and the received echo pulse thereof interacts with a high altitude secondary pulse provided by the oscillator to obtain a doppler signal at altitudes above range cutoff.

BRIEF DESCRIPTION OF THE DRAWING

A more complete understanding of the invention and many of the attendant advantages thereof will be readily appreciated as the same becomes better understood by reference to the following detailed description when considered in connection with the accompanying drawing wherein:

FIG. 1 is a block diagrammatic view of the high altitude pulse doppler ordnance fuze according to the present invention;

FIGS. 2–4 are schematic circuit views of various componential circuits of the fuze of FIG. 1; and FIGS. 5 and 6(*a*)–6(*f*) are graphical diagrams of various waveshapes associated with the fuze of FIG. 1.

DESCRIPTION OF THE PREFERRED EMBODIMENT

Figure 3:
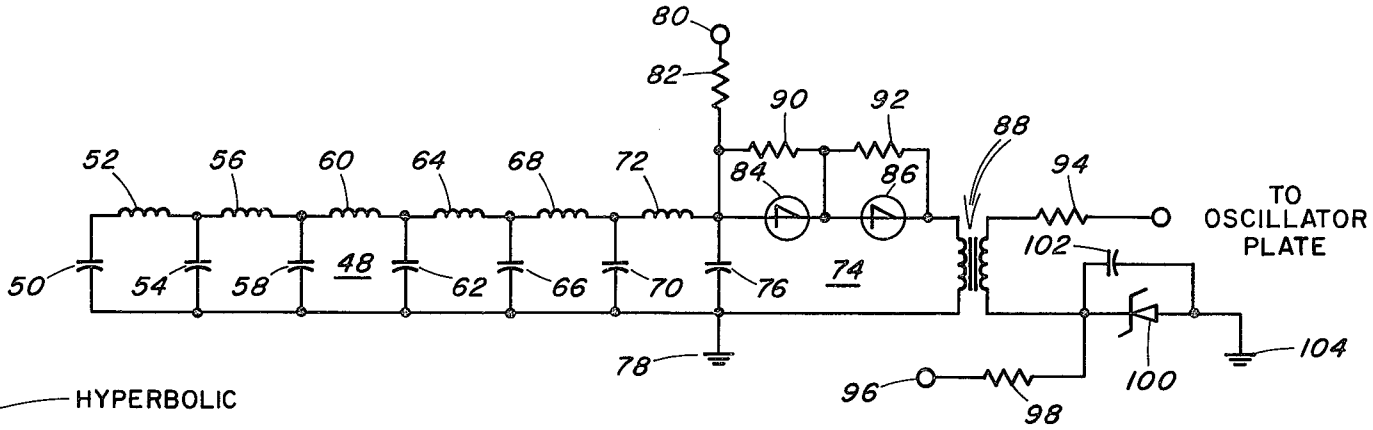

Referring now to the drawing wherein like reference numerals designate identical or corresponding parts throughout the several views and more particularly to FIG. 1 thereof, the high altitude pulse doppler fuze according to the present invention is shown as including a transmitter-receiver, such as an oscillator 10 adapted to transmit main pulse signals to a target, such as, for example, ground level (not shown), and to receive echo pulse signals of the transmitted pulses from the target. The echo of the main pulse signals received in the oscillator interacts with respective secondary pulses produced therein to provide a doppler signal indicative of target range.

Oscillator 10 is controlled by a modulator 12 connected thereto to provide the main and secondary pulse signals. As will be further explained, modulator 12 changes the mode of operation of the oscillator from a CW mode to a pulse mode. A detector 14 is connected to oscillator 10 and is gated to detect, for high altitude applications above range cutoff, the interaction of main pulse and secondary pulse signals. The gate signal for detector 14 is provided by a gate initiation circuit 16 responsive to the output of modulator 12. By way of example, gate initiation circuit 16 may be a differentiation network adapted to differentiate the trailing edge of the main modulator pulse as will be more fully explained hereinafter. The output signal provided by initiation circuit 16 actuates a delay circuit, such as, for example, a monostable multivibrator 18 connected thereto, which provides a delay pulse or other delay signal which is coupled to a gate circuit 20. Gate circuit 20, which may be, by way of example, a monostable multivibrator, is adapted to provide a gate signal to actuate detector 14 connected thereto during the interaction of the main and secondary pulse signals provided by oscillator 10. A conventional reset circuit 22 is connected to modulator 12 to provide a reset signal to delay monostable multivibrator 18 and gate monostable multivibrator 20 at the initiation of modulator operation to insure that the gate circuitry is properly set for operation. The output of detector 14 is provided with a terminal 24 to couple the detected doppler signal, corresponding to high altitude operation above range cutoff, to any utilization device, such as, for example, a firing circuit or the like (not shown).

Oscillator 10 and modulator 12 utilized in the present invention are somewhat similar in circuit configuration to the corresponding oscillator and modulator disclosed in copending application Ser. No. 14,833 hereinbefore identified.

Referring to FIG. 2, oscillator 10 is basically a Collpits power oscillator and includes an active circuit element, such as, for example, a triode 26 having cathode, grid, and plate electrodes 28, 30 and 32, respectively. a three-gap loop antenna 34 is integrated within the oscillator and is connected across grid 30 and plate 32. Capacitors 36 are included in the loop antenna and form, in combination with the antenna, the tank circuit for the oscillator. It is readily apparent that a separate antenna and a separate tank circuit may be utilized with the oscillator if so desired. Detector 14 and modulator 12 are connected to grid 30 and plate 32, respectively, by radially mounted isolation chokes 38 which are provided to isolate the detector and modulator from stray RF signals, RF countermeasure signals, or the like. For further protection from RF signals, detector 14 and modulator 12 may be mounted within a metal shield 40 concentric to loop antenna 34. A terminal 42, connectable to a source of dc power (not shown), is adapted to provide cathode 28 with a source of filament current via a resistor 44 and a bifilar choke 46 connected to the cathode.

As hereinafter more fully explained, oscillator 10 will assume a stable mode of oscillation when at least a minimum predetermined voltage is applied from modulator 12 to plate 32 of the oscillator. It is advantageous that at least this predetermined voltage be supplied to the plate circuit to keep the oscillator in the stable oscillatory mode since the oscillator will enter the super-regeneration region and, therefore, be more susceptible to capture by countermeasure signals, or the like, if the voltage applied to plate 32 falls below the predetermined minimum. As will be more fully explained hereinafter, the current flow from grid 30 is proportional to the applied plate voltage when oscillator 10 is in the stable oscillatory mode. Thus, any variation in plate voltage above the predetermined minimum results in a proportional variation in grid current. Furthermore, the grid current is responsive to returning echo signals from a target, or the like, received by loop antenna 34. Thus, by detecting the grid current variation due to a target echo signal received by antenna 34 while oscillator 10 is plate-pulsed, the doppler signal responsive to the relative motion between the ordnance fuze and the target may be obtained.

A modulator utilizable in the high altitude pulse doppler fuze of the present invention is shown in FIG. 3. The modulator, as hereinbefore, mentioned, is somewhat similar in circuit configuration to the modulator disclosed in application Ser. No. 14,833 and includes a pulse forming network, generally indicated at 48. The pulse forming network includes, by way of example, a plurality of LC sections 50–52, 54–56, 58–60, 62–64, 66–68 and 70–72 connected in cascade arrangement to a switching network generally indicated at 74. A capacitor 76 is connected across LC section 70–72 and ground terminal 78 and forms part of the switching network which is connectable to a source of dc power at a terminal 80 via a resistor 82 which forms together with the pulse forming network, a relaxation circuit to energize the pulse forming network with a predetermined pulse repetition frequency. Switching network 74 also includes a pair of conventional four-layer switching diodes 84 and 86 connected in series between the juncture of capacitor 76 and resistor 82 and one side of a step-up pulse transformer 88. Resistors 90 and 92 are parallel connected across switching diodes 84 and 86, respectively, to properly bias the diodes for switching operation. As hereinafter more fully explained, the modulator transfers voltage pulses formed in pulse forming network 48 to plate 32 of oscillator 10 to switch the oscillator from a CW mode to a pulse mode of operation upon actuation of switching diodes 84 and 86. The pulses are increased in magnitude by step-up transformer 88 whose output winding is connected to plate 32 of triode 26 via a resistor 94. Oscillator 10 is biased, between pulses supplied thereto, in the CW mode by the application of a dc biasing voltage of at least a predetermined magnitude sufficient to keep the oscillator in the stable oscillatory mode and out of the countermeasure-prone regenerative region of operation. More particularly, a dc voltage (not shown) is connectable to a terminal 96 to be applied to oscillator plate 32 by way of a resistor 98, the output winding of transformer 88, and resistor 94. A unidirectional breakdown device, such as a Zener diode 100, is parallel connected across a capacitor 102 and coupled between the juncture of resistor 98 and the transformer output winding and ground potential 104. The breakdown voltage of Zener diode 100 establishes the minimum predetermined voltage supplied to oscillator 10. Thus, the breakdown voltage of the Zener should be so chosen as to keep oscillator 10 in the stable oscillatory mode and out of the regenerative region. Capacitor 102 acts as an ac short to shunt any ac biasing signals to ground 104.

As will be more fully explained hereinafter, a deliberate impedance mismatch exists between modulator 12 and oscillator 10 to cause reflected, secondary pulses to be transferred from the modulator to the oscillator. The secondary pulses interact with the corresponding received echoes of the primary pulses transmitted by the oscillator to provide a high altitude doppler signal. The interaction of the primary echo pulses and the secondary pulses reflects itself in a variation of grid current which is sensed in the gated detector of FIG. 4. The gated detector is a peak diode detector including a unidirectional semiconductive diode 106, or the like, the anode of which is coupled to a parallel connected resistor and capacitor 108 and 110, respectively. A variable impedance switch, such as, for example, a transistor 112 is connected to the cathode of diode 106. Transistor 112, which is normally in a saturated state, is rendered non-conductive, by the application of a gate signal at a terminal 114 received from gate monostable multivibrator 20, to enable the diode detector to detect the doppler signature by detecting the variation in grid current supplied from oscillator grid 30 via a terminal 116 connected between oscillator 10 and diode 106. A semiconductive diode 118 is connected between terminal 116 and ground potential 120 to shunt positively going signals to ground since the detector is adapted to detect the negatively going portion of the doppler signature. It is readily apparent that the detector may be adapted to detect the positively going envelope if so desired by reversing the polarity of elements 106, 112 and 118 and by applying a signal of proper polarity at terminal 114.

Figure 5:
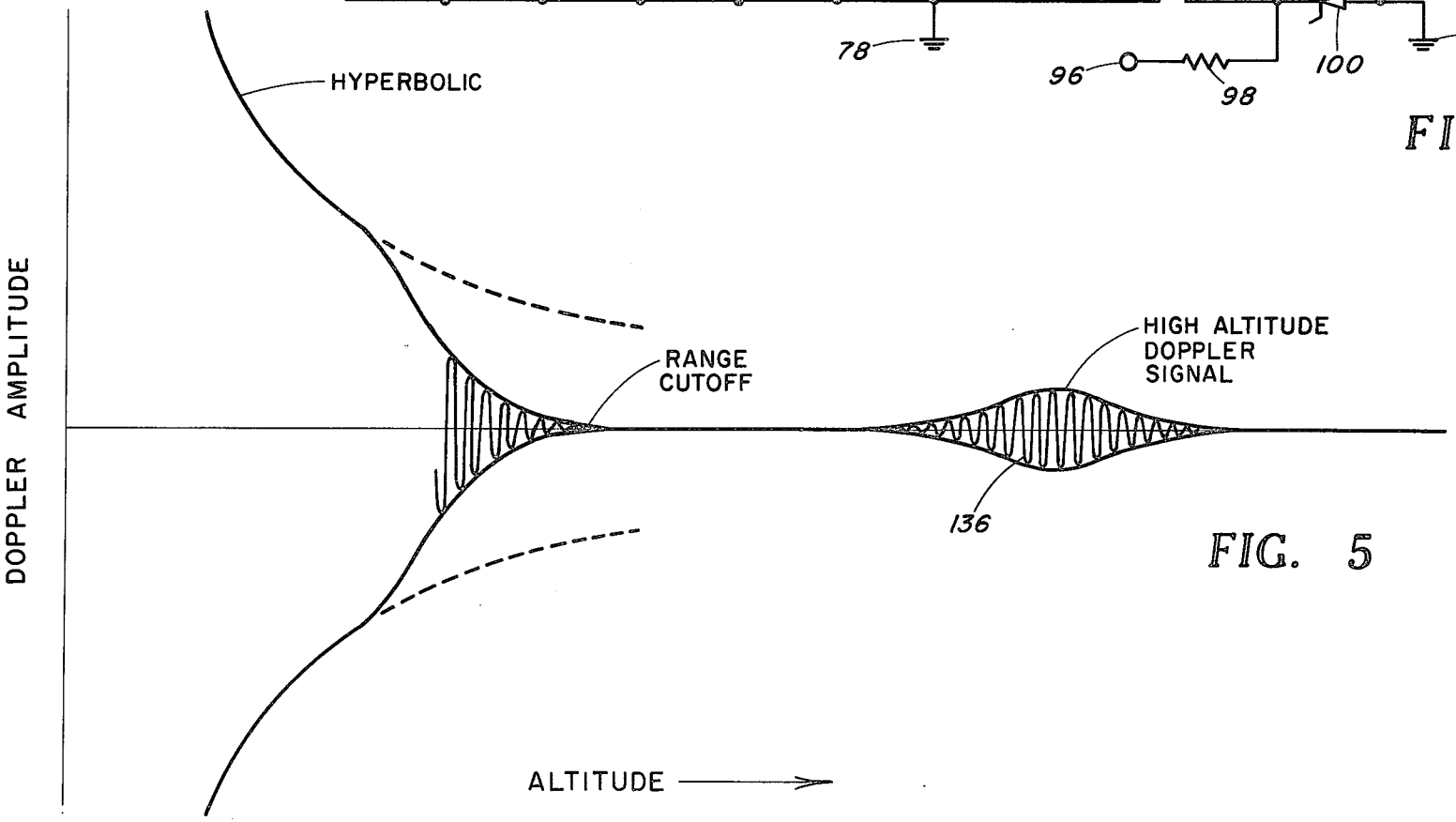

The operation of the high altitude pulse doppler fuze according to the present invention may be better understood by reference to FIG. 5 which shows the doppler signature of a pulse doppler fuze approaching a relatively stationary target (not shown). As shown therein, prior art pulse doppler fuzes have been limited to altitude operation below range cutoff. At range cutoff, the hyperbolic signature of the doppler signal is modified and quickly falls to zero corresponding to zero interaction between the transmitted and received echo pulses which must both be present for proper doppler operation. The fuze according to the present invention provides a doppler signal above range cutoff and, therefore, obtains high altitude operation by allowing the received echoes of the transmitted pulses to interact with secondary pulses produced in the oscillator during receipt of the echo pulses. FIG. 6(*a*) shows the output of modulator 12 as including a series of primary voltage signals 122*a*, 122*b*, etc. and secondary voltage signals 124*a*, 124*b*, etc. which are applied to plate 32 of oscillator 10. Signals 122*a* and 124*a* are separated by a distance T corresponding to the high altitude operation of the fuze, as will hereinafter be explained, while the time between signals 122*a* and 122*b* is on the order of from approximately 20T to 40T. The application of primary voltage pulse 122*a* to plate 32 causes oscillator 10 to switch from a stable CW mode of operation to a stable pulse mode of operation. Oscillator 10, responsive to pulse 122*a*, radiates a pulse signal from antenna 34 to a target (not shown) similarly to that disclosed in application Ser. No. 14,833. Pulse 122*a* is produced in modulator 12 by the application of a voltage to terminal 80 which energizes pulse forming network 48. When the voltage across the pulse forming network reaches a predetermined value, switching diodes 84 and 86 actuate and the voltage, increased in amplitude by step-up transformer 88, is transferred to plate 32 of the oscillator. As a result of the impedance mismatch between modulator 12 and oscillator 10, the transferred voltage pulse 122*a* causes a reflected, secondary voltage pulse 124*a* to be impressed across the oscillator a predetermined time T after the application of the main pulse. It is readily apparent that predetermined time T may be varied to any desired value by adjusting the impedance mismatch between the modulator and the oscillator. It is to be noted that oscillator 10 is always maintained in a stable mode of operation by the application of at least a predetermined voltage V across plate 32 thereby keeping the oscillator out of the countermeasure-prone regenerative region.

The interaction in oscillator 10 of the received echo of the main transmitted pulse and the corresponding secondary pulse produced therein results in a grid current variation for providing high altitude doppler operation. More particularly, the received echo of the transmitted pulse as a result of modulator signal 122*a* interacts with the secondary pulse produced in oscillator 10 as a result of modulator signal 124*a*, the received echo of the transmitted pulse resulting from modulator signal 122*b* interacts with the secondary pulse produced in the oscillator resulting from modulator signal 124*b*, and so on, to provide a doppler signal at altitudes of T/2 feet above the target wherein T is measured in nanoseconds and is the time between signals 122*a* and 124*a* or between 122*b* and 124*b*. The variation in grid current is detected in detector 14 which is gated to detect current variation during the interaction of the echo of the main transmitted pulses and corresponding secondary pulses.

Reference to FIGS. 6(*b*)–6(*e*) shows various waveforms utilized to gate detector 14 ON at the proper time interval to obtain high burst height operation. FIG. 6(*b*) show the output of reset circuit 22 which provides a pulse 126*a*, responsive to the leading edge of main pulse 122*a*, to insure that the various gate circuit components, such as, monostable multivibrators 18 and 20 are properly set for operation. The trailing edge of main pulse 122*a* is differentiated in gate initiation circuit 16 provide pulse 128*a* of FIG. 6(*c*) which, in turn, actuates monostable multivibrator 18 to produce delay pulse 130*a* of FIG. 6(*d*). Delay pulse 130*a* is of such duration as to gate detector 14 ON during the occurrence of secondary pulse 124*a*. More particularly, monostable multivibrator 20 is responsive to the trailing edge of pulse 130*a* to produce, as indicated in FIG. 6(*e*), gate pulse 132*a* which brackets, in time, the occurrence of secondary pulse 124*a*. Gate pulse 132*a* is coupled to terminal 114 of the diode peak detector and renders transistor 112, which is normally in saturation absent gate pulse 132*a*, into the cutoff region. More particularly, FIG. 6(*f*) which shows the voltage across transistor 112 indicates that when the transistor is saturated the resistance thereof is essentially zero and the voltage drop across the transistor due to grid current flow therethrough is substantially zero and therefore, no signal will be detected by the peak diode detector. During the interval of pulse 132*a*, that is, when a gate pulse is applied to terminal 114, the transistor enters cutoff and the resistance thereof rises appreciably with a corresponding increase in voltage drop due to grid current flow through the transistor. The sequence is repeated for modulator signals 122*b* and 124*b* which provides a voltage pulse 134*b* which is impressed across the peak diode detector. The amplitudes of voltage pulses 134*a* and 134*b* are not the same, however, but are related to the magnitude of grid current flow during modulator signals 124*a* and 124*b* which, in turn, is a function of the doppler effect between the target and the fuze. More particularly, diode detector 14 detects the envelope of the amplitude of pulse train 134*a*, 134*b*, etc. to provide a sinusoidal varying signal which is the sinsusoidal high altitude doppler signal indicated in FIG. 5 at 136.

It is readily apparent, therefore, that the present invention provides an ordnance fuze operable at altitudes above range cutoff. Obviously, numerous modifications and variations of the present invention are possible in light of the above teachings. Thus, while the invention has been disclosed as a pulse doppler ordnance fuze, it is readily apparent that the invention is utilizable elsewhere such as, for example, in a target detecting device, a doppler radar system, or the like. Similarly, the invention may utilize a separate oscillator and antenna rather than the integrated oscillator-antenna disclosed. It is to be understood, therefore, that within the scope of the appended claims the invention may be practiced otherwise than as disclosed herein.

What is new and desired to be claimed by Letters Patent of the United States is:

1. A high altitude pulse doppler ordnance fuze comprising means for producing oscillatory signals, means for normally biasing said oscillatory signal producing means into a continuous mode of oscillation and for periodically biasing said oscillatory signal producing means into a pulse mode of operation to provide main oscillatory pulse signals and secondary oscillatory pulse signals, means for radiating said main oscillatory pulse signals to a target and for receiving echo pulse signals therefrom, and means for detecting the interaction of said received echo pulse signals and said secondary pulse signals to provide a signal indicative of the doppler effect between said target and said fuze.

2. A high altitude pulse doppler ordnance fuze according to claim 1 further comprising means for rendering said detecting means responsive to signals applied thereto during production of said second oscillatory pulse signals and for rendering said detector means unresponsive to signals applied thereto elsehwere.

3. A high altitude pulse doppler ordnance fuze according to claim 2 wherein said means for producing oscillatory signals is a plate pulsed oscillator having a vacuum tube with a plate, a gird, and a cathode, said biasing means provides voltage signals to the plate of said pulsed oscillator, the variation of grid current of said plate pulsed oscillator is proportional to the doppler effect between said target and said fuze, the time duration between said main oscillatory pulse signals and corresponding secondary oscillatory pulse signals provides doppler information at distances beyond range cutoff, and said secondary oscillatory pulse signals are reflected signals of said main oscillatory pulse signals responsive to an impedance mismatch between said biasing means and said oscillatory signal producing means.

4. A high altitude pulse doppler ordnance fuze comprising a plate pulsed oscillator having a grid, plate, and cathode, modulator means connected to the plate of said oscillator for biasing said oscillator into a continuous mode of operation and for plate pulsing said oscillator to produce a main oscillatory signal and a secondary oscillatory signal, the time duration between said main oscillatory signal and said secondary oscillatory signal responsive to the impedance mismatch between said oscillator and said modulator means, a loop antenna connected between said grid and said plate of said oscillator for radiating said main oscillatory signal to a target and for receiving the echo of said radiated main signal, a detector connected to the grid of said oscillator for monitoring the variation in grid current due to interaction of said echo signal and said secondary oscillatory signal, and gating circuitry connected between said modulator means and said detector for rendering said detector operational during production of said secondary oscillatory signal.

* * * * *